United States Patent [19]

Verschuur

[11] 4,126,426

[45] Nov. 21, 1978

[54] AGGLOMERATING COAL SLURRY PARTICLES

[75] Inventor: Eke Verschuur, Amsterdam, Netherlands

[73] Assignee: Shell Oil Company, Houston, Tex.

[21] Appl. No.: 860,014

[22] Filed: Dec. 12, 1977

[30] Foreign Application Priority Data

Jun. 14, 1977 [GB] United Kingdom ..... 24836/77

[51] Int. Cl.[2] ..... C10L 5/14; C10L 5/00

[52] U.S. Cl. ..... 44/24; 44/10 R; 44/23; 241/20; 210/74

[58] Field of Search ..... 44/1 R, 10 R, 23, 24, 44/51; 241/20, 21, 24; 302/14; 210/74

[56] References Cited

U.S. PATENT DOCUMENTS

| | | | |
|---|---|---|---|
| 2,590,733 | 3/1952 | Stillman | 44/51 |
| 3,168,350 | 2/1965 | Phinney et al. | 302/14 |
| 3,579,442 | 5/1971 | Gerwig | 210/74 X |
| 3,775,070 | 11/1973 | Messer et al. | 44/10 R |
| 3,957,456 | 5/1976 | Verschuur | 44/23 X |
| 4,021,206 | 5/1977 | Huberts et al. | 44/10 R |

*Primary Examiner*—Carl Dees

[57] ABSTRACT

A process for preparing a solid load of coal from an aqueous slurry of coal particles by dividing the slurry into a first fraction containing relatively small particles and a second fraction containing relatively large particles, agglomerating the particles in the first fraction under turbulent conditions with a binder and separating the thus-obtained agglomerates from the water phase and mixing the agglomerates with the second fraction.

7 Claims, No Drawings

AGGLOMERATING COAL SLURRY PARTICLES

BACKGROUND OF THE INVENTION

Aqueous slurries of coal particles become available at a number of places, such as at a mine site where coal is mined with the aid of water and at the end of a pipeline wherein the coal is transported with water as the carrier liquid. These slurries generally contain coal particles of different sizes in a more or less continuous spectrum from small to large. In order that the slurry is easily flowable, the total amount of solids therein is limited, e.g. to 50 percent by weight. For such purposes as shipment or combustion, the amount of water in the slurry will then be too high.

Accordingly, the slurry has to be treated to the extent that one or more products are obtained that contain less or considerably less water. A problem in this respect is that large and small particles tend to behave quite different in most dewatering processes, and in fact, require different methods of dewatering. The small particles are more difficult to dewater than the large particles, and when the large and small particles are separated and separately dewatered, the small particles require an expensive dewatering process and dewatering give rise to dusting problems, remixing of large and small particles then being difficult or impossible.

The present invention proposes a process wherein the above problems are solved and whereby a dewatered load of coal is obtained from an aqueous slurry of coal particles in an economic way.

SUMMARY OF THE INVENTION

According to the invention, the slurry is divided into a first fraction containing relatively small particles and a second fraction containing relatively large particles; subsequently, the particles in the first fraction are agglomerated under turbulent conditions with an amount of less than 10 weight percent of a binder, based on the weight of said small particles; then the thus-obtained agglomerates are separated from a water phase; and finally, the agglomerates are mixed with the second fraction either before or after mechanical drying.

DESCRIPTION OF PREFERRED EMBODIMENTS

In accordance with the present invention, the small coal particles in a slurry need not be separated as such from the slurry of water; which separation would be costly—because of power and apparatus requirements—and troublesome—because of dusting problems. Such separation is avoided by forming agglomerates of the small particles.

Since the agglomerates need only to be strong enough to withstand separation from the water and subsequent handling, not much binder is required for their formation.

Separation of agglomerates from water is much easier than separation of small coal particles from water. Agglomeration is the process of preferential wetting of coal particles by binder liquid in an aqueous environment, whereby the coal particles become sticky and form clusters or agglomerates. These agglomerates are water-repellent and can easily be separated from the water, e.g. by taking them up in excess hydrocarbon or by sieving them off. Under turbulent conditions, the binder is intimately mixed with the coal particles. Preferably, binders based on liquid hydrocarbons are used.

The agglomeration can be carried out as a continuous process by feeding the fraction of small coal particles in water and the liquid binder into a stirred vessel and by withdrawing water containing agglomerates from the vessel.

According to the invention, the aqueous slurry of coal particles is divided into a first fraction containing relatively small particles and a second fraction containing relatively large particles. This can be accomplished by known and readily available techniques, such as classification.

Further, according to the invention, the agglomerates—after having been separated from the water phase—are mixed with the second fraction, either before or after mechanical drying. Mechanical drying can be carried out by known techniques, such as on a filter or by centrifuge. It will be clear that a number of possibilities exist for the order in which the drying is carried out:

- the agglomerates can be mixed as such with the second fraction, the mixture being subsequently dried,
- the agglomerates and/or the second fraction can be separately partly dried before being mixed, followed by a subsequent drying of the mixture.
- either the agglomerates or the second fraction can be dried completely before mixing, after which the mixture is further dried.

Preferably, according to the invention, the mixture, after having been dried mechanically, is further dried thermally, e.g. in a fluidized bed. It can be economically advantageous to dewater the mixture or the agglomerates less deeply by mechanical means and to further dry the mixture thermally. When using a fluidized bed for drying the mixture with a hot gas, it is possible to withdraw coal particles below a certain minimum size separately from the bed to recycle them to the agglomeration step, whereby the product of the process, according to the present invention, contains no coal fines below a certain size.

According to a preferred embodiment of the present invention, the coal slurry is divided into a first fraction that predominantly contains particles smaller than 0.1 mm and a second fraction containing predominantly particles larger than 0.1 mm. This division leads to favorable results, since particles of a size below 0.1 mm can easily be agglomerated with less than 10 weight percent binder and the larger particles generally do not need an agglomeration before they can easily be dewatered.

A special advantage of the process, according to the present invention, is obtained when the first fraction contains ash. During agglomeration, this ash is not taken up in the agglomerates, so that it is left in the water phase when separating the formed agglomerates therefrom. Accordingly, a deashing of the coal is accomplished thereby.

When agglomerating the coal particles in the first fraction with a small amount of binder, relatively weak agglomerates are obtained that still contain much water, e.g. more than 30 weight percent. Accordingly, the invention proposes to further dewater the agglomerates, either separately or in a mixture with the second fraction or the second fraction in a partly or wholly dewatered state. According to a preferred embodiment of the invention, this dewatering is carried out to the extent that a solid load of coal is obtained that has a water content of below 15 weight percent. This can be done by mechanical dewatering only or by mechanical dewatering, followed by thermal dewatering.

According to another embodiment of the invention, the agglomeration of the coal particles in the first fraction is carried out at elevated temperature, and the mechanical drying of the agglomerates and the second fraction is also carried out at elevated temperature. By agglomerating the coal particles at elevated temperature, a binder based on heavy hydrocarbons can be used that would have too high a viscosity at ambient temperature or that even would be solid. These binders are cheap and very efficient in agglomerating coal particles. Also, the agglomerates become available at elevated temperature in this case and can then be dewatered mechanically at elevated temperature without preheat. Mechanical dewatering of the agglomerates and the second fraction at elevated temperature requires less power than at ambient temperature in a centrifuge.

The invention also relates to the solid load of coal as obtained from the process, according to the invention as described above.

The invention will further be elucidated by an example below.

EXAMPLE

An amount of aqueous coal slurry, containing 50%w solid material (mainly coal and ash) was dewatered in a centrifuge to a water content of 10%w. The particle size distribution of the obtained mass was as follows:

15%w smaller than 44 μm
25%w smaller than 150 μm
2%w larger than 1.5 mm

Subsequently, the mass was mixed with hot water (80° C.) so that a hot slurry was obtained which contained 10%w solids. This slurry was classified at a size of 150 μm in a cyclone in order to obtain a flow of particles as overflow that predominantly consisted of particles smaller than 150 μm and a flow of particles as underflow that predominantly consisted of particles larger than 150 μm.

Although the throughput through the cyclone could be increased fourfold as compared with ambient temperature operation, the fraction of particles larger than 150 μm in the overflow was only 9%w as compared with 25%w in the case of operation at ambient temperature. The fraction of particles smaller than 150 μm in the underflow was only 6%w instead of 12%w in the case of operation at ambient temperature.

The hot slurry of particles mainly smaller than 150 μm obtained as overflow from the cyclone was treated in an agglomeration device at turbulent conditions with an amount of 8%w short residue ex Kuwait crude oil (based on the weight of the solids in the slurry). The agglomerates thus obtained were separated from an ash-containing water phase with a sieve. The ash content of the agglomerates was 10%w as compared to the ash content of 22%w of the said overflow. The agglomerates coming from the sieve still contained 42%w water.

Subsequently, the obtained agglomerates were mixed with the hot underflow from the cyclone and the obtained mixture was then dewatered in a centrifuge to a water content of 6%w. The hot mass of agglomerates and large particles thus obtained was further dried to a water content of 3%w in a fluidized bed through which air of ambient temperature was blown. The coal dust (particles smaller that 50 μm mainly) that was carried off from the fluidized bed with the off-gas was briquetted with the aid of the above-mentioned short residue, used in an amount of 8%w of the weight of the dust and the obtained briquettes were mixed with the mass of coal that was obtained from the fluidized bed.

The product thus obtained consisted of 20.6%w agglomerates; 75.1%w large particles and 4.3%w briquettes. The agglomerates contained 10.0%w ash, the large particles 16.6%w ash and the briquettes 4.1%w ash.

The water content of the final product was found to be 2.6%w and the product contained 1.2%w particles smaller than 150 μm. The product was esentially non-dusting.

What is claimed is:

1. A process for preparing a solid load of coal from an aqueous slurry of coal particles which comprises dividing the slurry into a first fraction containing relatively small particles and a second fraction containing relatively large particles, agglomerating the particles in the first fraction under turbulent conditions with an amount of less than 10 weight percent, based on the weight of the small particles, of a binder and separating the thus-obtained agglomerates from a water phase and mixing the agglomerates with the second fraction.

2. A process as claimed in claim 1 in which the mixture is dried mechanically and then further dried thermally in a fluidized bed.

3. A process as claimed in claim 1 in which the first fraction predominantly contains particles smaller than 0.1 mm and the second fraction particles larger than 0.1 mm.

4. A process as claimed in claim 1 in which the first fraction contains ash.

5. A process as claimed in claim 1 in which a binder based on liquid hydrocarbons is used.

6. A process as claimed in claim 1 in which a solid load of coal is prepared having a water content of below 15 weight percent.

7. A process as claimed in claim 1 in which the agglomeration of the coal particles in the first fraction is carried out at elevated temperature and in which mechanical drying of the agglomerates and the second fraction is also carried out at elevated temperature.

* * * * *